US005275342A

United States Patent [19]

Galanty

[11] Patent Number: 5,275,342

[45] Date of Patent: Jan. 4, 1994

[54] SOLID WASTE CRUSHER AND SIZING APPARATUS

[76] Inventor: William B. Galanty, 16 Falmouth St., Short Hills, N.J. 07028

[21] Appl. No.: 753,089

[22] Filed: Aug. 30, 1991

[51] Int. Cl.[5] ..... B02C 18/06; B02C 18/40

[52] U.S. Cl. ..... 241/73; 241/236; 241/DIG. 38

[58] Field of Search ..... 241/236, 293, 73, DIG. 38

[56] References Cited

U.S. PATENT DOCUMENTS

| | | | |
|---|---|---|---|
| 3,633,831 | 1/1972 | Dodson et al. | 241/61 |
| 3,664,592 | 5/1972 | Schweigert et al. | 241/166 |
| 3,860,180 | 1/1975 | Goldhammer | 241/27 |
| 4,385,732 | 5/1983 | Williams | 241/236 |
| 4,565,330 | 1/1986 | Katoh | 241/236 |
| 4,706,899 | 11/1987 | Parker et al. | 241/73 |

FOREIGN PATENT DOCUMENTS

| | | | |
|---|---|---|---|
| 688590 | 2/1940 | Fed. Rep. of Germany | 241/236 |

*Primary Examiner*—Mark Rosenbaum

*Assistant Examiner*—John M. Husar

*Attorney, Agent, or Firm*—Clay Holland, Jr.

[57] ABSTRACT

An improved apparatus for shredding, crushing and grinding solid waste materials to the desired particle sizes and shape for waste disposal or other uses is provided in which two unitary i.e. one-piece shredding members having a composite cutting teeth and tooth spacing arrangement in intermeshing shredding relationship mounted on substantially parallel shafts and are positioned in a transverse arrangement to the direction of waste material flow as it is introduced into the crushing apparatus. A shredding element of each shredding member interacts with an element of the other member whereby the shredding elements cooperatively interact on an inlet side of the apparatus. On an outlet or discharge side of the interacting members is positioned relative to a sizing means or screen useful for the passage of solid waste material particles of predetermined size and configuration, while simultaneously rejecting the passage of other improperly sized and shaped particles, for reprocessing through the apparatus.

17 Claims, 7 Drawing Sheets

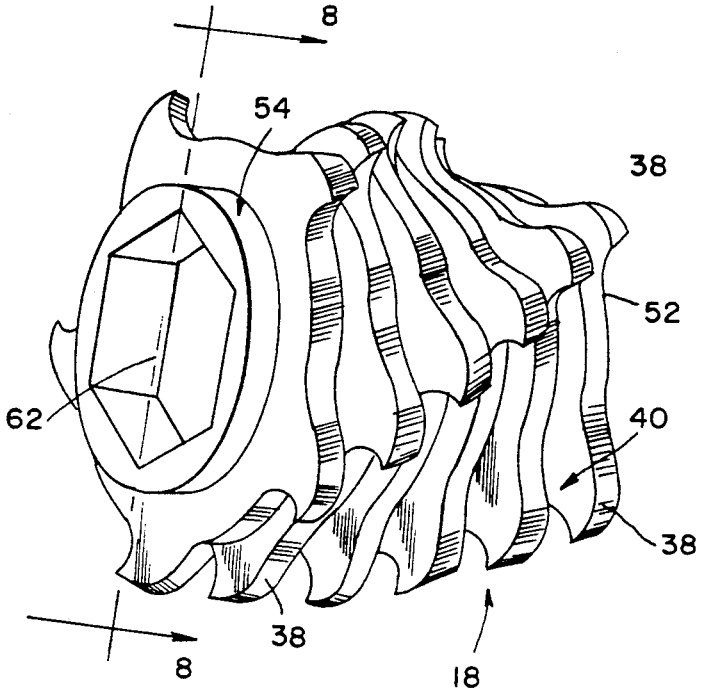
FIG. 7
FIG. 10
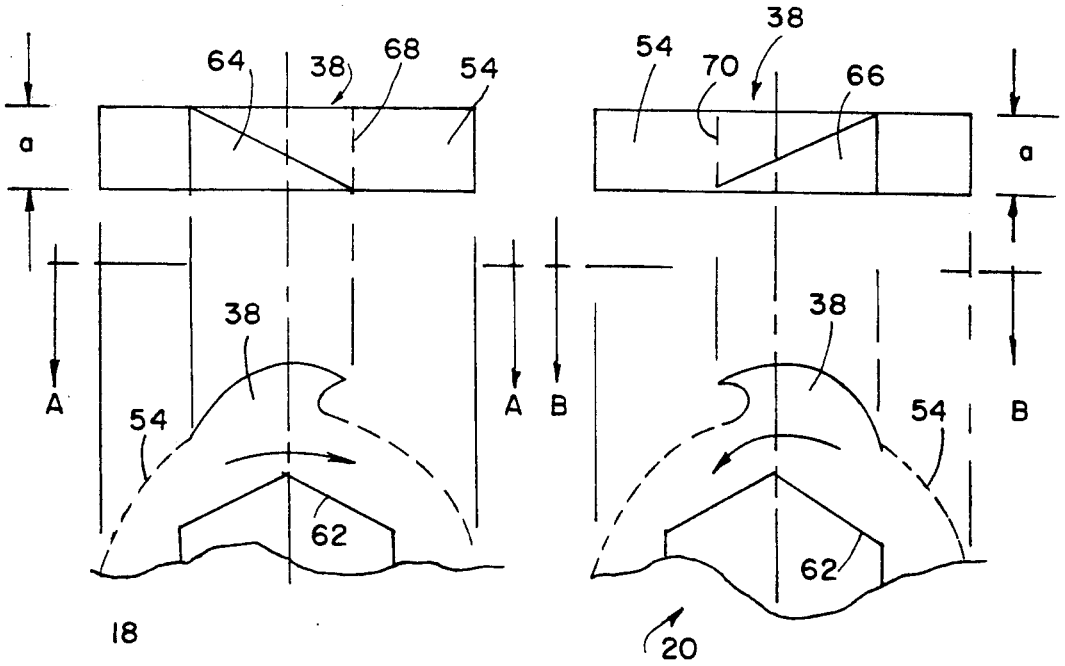

SOLID WASTE CRUSHER AND SIZING APPARATUS

BACKGROUND OF THE INVENTION

The present invention relates to a form of solid waste material shredding and comminuting apparatus. Comminution, or the reduction of particle size of solid waste material to small or minute particles, is preformed by shearing, shredding and crushing and the like of the waste material. Such comminution is commonly performed by feeding solid waste material into the interface of counter-rotating intermeshing cutter members. Shearing action may occur when particles of waste material are cut or crushed by the "scissors" action between cutters on one shaft and those on the other shaft due to overlap of root diameters of the cutters. The particles may also be shredded by the tearing action of the leading edge of a cutting element against solid material trapped between cutting elements of the opposite stack.

In the prior art of such comminution apparatus there is provided a pair of rotating shafts with their axes of rotation parallel to one another, with sets or stacks of individual cutter disks and spacers fixedly mounted on each shaft, and mutually intermeshing. The spacers are to maintain a fixed separation between the teeth of the cutter disks. When such apparatus is operated over a long period of time, the individual cutter disks and/or the shredding teeth thereof may become dislodged, distorted broken-off or slip in rotation along the axis of the shaft owing to the fact that such cutter disks and teeth are subject to large shear, shock, bending and torsion forces which must be borne or carried solely by an individual disk or tooth. Stated differently, there is no opportunity for sharing or distribution of such forces among the various adjacent disks, teeth or spacers along the axis of the shaft. Consequently, such prior art devices are subject to many undesireable drawbacks and disadvantages, which may be observed as, for example, in the accummulation of waste material between the cutter members, failure of one or more of the cutter disks to rotate, misalignment of the cutter teeth, anyone or all of these may produce reduced comminution efficiency and reliability and the like.

Apparatus of the type to which the present invention relates, are known and described in the prior art, for example, such as U.S. Pat. No. 4,046,324, to Joseph W. Chambers, issued Sept. 6, 1977, entitled "Solid Waste Comminution". This device has two interacting stacks of shredding members mounted on substantially parallel shafts and are positioned in transverse arrangement with respect to the direction of the waste material is introduced into the comminutor apparatus. A shredding disk of each stack interacts with a shredding member on the other stack, whereby the individual cutter members cooperatively interact in pairs within the comminutor. Teeth are provided on at least one member of each pair of shredding members for cutting during rotation thereof. The primary novelty of this prior art apparatus appears to reside in the existence of cutter disks having shredding members or teeth for cutting in both directions of shaft rotation and the ability of the shafts to be driven in either direction, whereby the device cuts in both directions.

In another U.S. Pat. No. 4,690,340, to Takefumi Hatanaka, issued Sept. 1, 1987, entitled "Waste Material Shredder", there is disclosed an apparatus having a pair of counter-rotating cutter rollers with mutually meshing individual cutter disks mounted thereon and fixed individual spacer members separating the cutter disks. This device is directed toward eliminating jamming of the shredder due to the build-up of chips during the shredding of sheets of waste material between the spacers. Jamming of the device is said to be eliminated by a special configuration of the cutter disks, with chip clearance protrusions being formed between the peripheral teeth which act to remove such chips, thereby overcomming a problem with prior art "cross-cut" type shredders.

In other U.S. Pat. Nos., Ser. No. 4,565,330, to Hiroharu Katoh, issued Jan. 21, 1986, entitled "Shredding Apparatus", and entitled "Apparatus for Shredding Rubber Tires", each also discloses cutter disks with separating spacer disks disposed on substantially parallel twin shafts which are rotatable in opposing directions in intermeshing relationship.

Each of the above cited patented apparatus and other prior art patents not cited utilize as the novelty the individual cutter and spacer disk arrangements for their operation. Various protruding teeth configurations, multiple teeth on the disk, differences in root diameters of the cutter teeth and spacers and the like are utilized to accommodate a wide variety of waste materials to enhance the efficiency and reliability of such prior art devices. However, none of the known prior art devices solves the long standing and continued problems of poor efficiency shredding, sizing, jamming, distortion, broken teeth or dislodgement of cutter disks or teeth when such arrangements are utilized. Thus, it appears that the most common technique in the prior art is to use alternate stacking of cutters and spacer disks on shafts to provide an arrangement for the shredder intermeshing or inter-action have not realized or appreciated the need to provide an arrangement which is strong and durable and which is capable of distributing the stresses encounted therein along the axial length of the apparatus rather than having it concentrated on the individual cutter and disk members.

In U.S. Pat. Nos., Serial No. 3,664,592, to Luitpold Schweigert, issued May 23, 1972, "entitled Machine for Granulating Bulk Rubbish or Bulky Refuse of any Kind ", there is disclosed a machine for comminuting bulky refuse. The machine includes a pair of parallel rotary shafts, which have distributed therealong a plurality of rotary cutters and affixed thereto for rotation therewith, with cutters being spaced apart from each other along the shaft and with each cutter having a single tooth and the teeth of the cutters distributed along each shaft being angularly staggered about the axis of each shaft consistent with prior art practices.

The cutters on one shaft are aligned with the spaces between the cutters on the other shaft while each cutter has a circular portion fixed to the shaft and the single tooth of each cutter projects beyond the circular portion of each cutter. The single cutting tooth on the several cutters of one shaft move through the spaces between the circular portions of the cutter on the other shaft. The rotary shafts with the cutters thereon are housed within a trough-shaped housing carrying an upper inlet through which material is supplied to the cutters, this housing having a lower outlet situated beneath the rotary cutters at a location adjacent to the space through which the teeth of the cutters turn during rotation of the shafts. This lower outlet of the housing carries a structure which prevents the comminuted material from passing through the outlet until this material has been reduced to a given size, and the cutting teeth function not only to comminute the material, but also to repeatedly act on the material until it has been reduced to the size required to pass beyond the outlet.

SUMMARY OF THE INVENTION

An improved solid waste material refuse crusher and sizing apparatus according to the present invention is provided, comprising a pair of unitary counter-rotating multiple toothed cutter members for twin shaft shredders, with axes of rotation for these cutters being disposed substantially parallel to one another. Each of the multiply toothed cutter members is of a unitary or one piece body construction, and is produced and adapted with protrusions or teeth at regular spaced intervals around a cylindrical axial periphery of the cutter along and perpendicular to the axis of the shafts in a preselected configuration of a staggered-like arrangement. Along the length of the shaft the protruding teeth are in a formation that appears to be rows transverse to the axis of the shafts equally spaced apart from adjacent appearing rows. The intervening space formed between each apparent row of protruding teeth is in the form of a spacer whose diameter or root is less than that of peripheral circle defined by the tips of the cutter teeth of each row adjacent thereto. Thus, when viewed from a direction transverse to the axis of the shaft, the multiple toothed cutter elements may appear to be a series of cutter-disks with alternate spacer disks similar in appearance to that of the prior art, but is in fact a unitary one piece structure, whose teeth form multiple spiral-like teeth patterns along the axis of the shafts. In accordance with the inventive concept of the present invention, such multiple toothed cutter elements may be only several inches in length or may be several feet long. The apparatus of the present invention also includes two semicircular connected slotted members forming a twin-trough-like screen device which is axially disposed and extends substantially the length of the multiple toothed cutter below it in a predetermined spaced relationship therewith to the discharge or outlet side of the cutter array. Properly sized waste material pieces are caught by the screen for further sizing. Such retained pieces are subsequently carried back through the cutters, i.e. repeatedly for proper sizing by the counter-rotating cutter elements, in accordance with the teachings of the invention.

Another embodiment of the invention relates to the unique manner in which the individual unitary multiple toothed cutter members are fabricated to produced the novel cutter tooth array which has been found to be suitable for a wide range of waste materials currently encountered in our ecologically conscious world.

BRIEF DESCRIPTION OF THE DRAWINGS

Realization of the unique features and advantages along with others of the present invention will be more apparent from the following description and accompanying drawings in which:

FIG. 7, is a perspective view of a twin shaft multiple toothed cutter member apparatus shown in the various views, that is produced by the shown in FIG. 6;

FIG. 10, is the dipiction of the details of typical cutting teeth and their configuration as envisioned by the present invention.

DESCRIPTION OF REPRESENTATIVE EMBODIMENTS OF THE INVENTION

Figure 1:
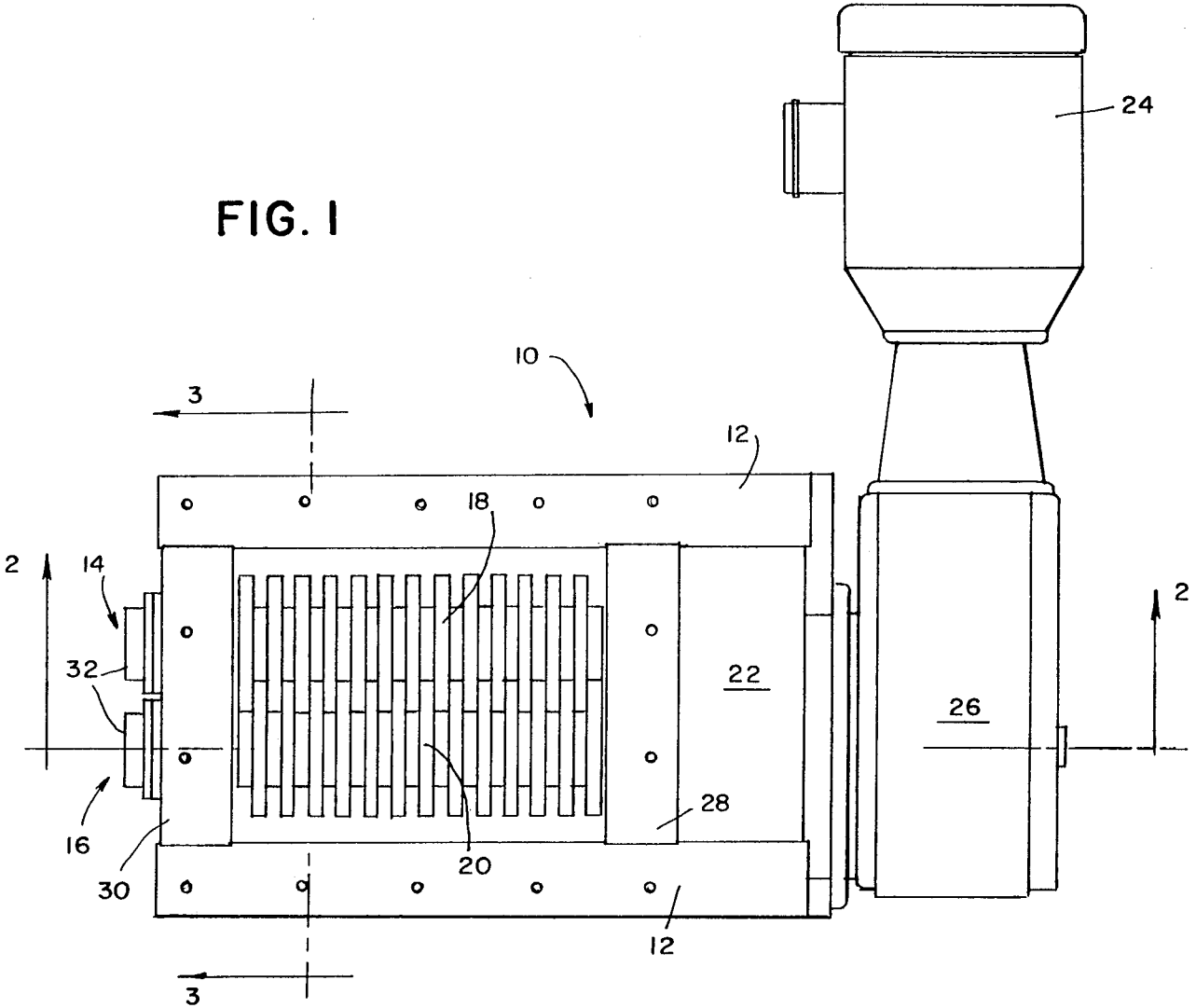
FIG. 1, is a plan view of a crushing and sizing apparatus embodying the invention.

Referring now to the various drawings, there is shown in FIG. 1, a representative embodiment of an improved crushing and sizing apparatus 10 which includes a housing 12 of trough-shaped configuration for accommodating twin shafts 14 and 16, and unitary cutter body members 18 and 20 mounted respectively on twin shafts 14 and 16 that are hexagonal in their cross-section. A drive arrangement 22 is connected to shafts 14 and 16 to provide opposing rotational motion thereto. The rotational speed of these shafts are different from each other and may be reversed in direction of rotation by means of drive arrangement 22. Drive arrangement 22 is connected to an electrical drive motor 24 through a drive mechanism 26, which may be for example a series of pulleys and belts or multi-gear drives. Also there is a pair of housing and support members, a front member 28 and a rear member 30.

Figure 2:
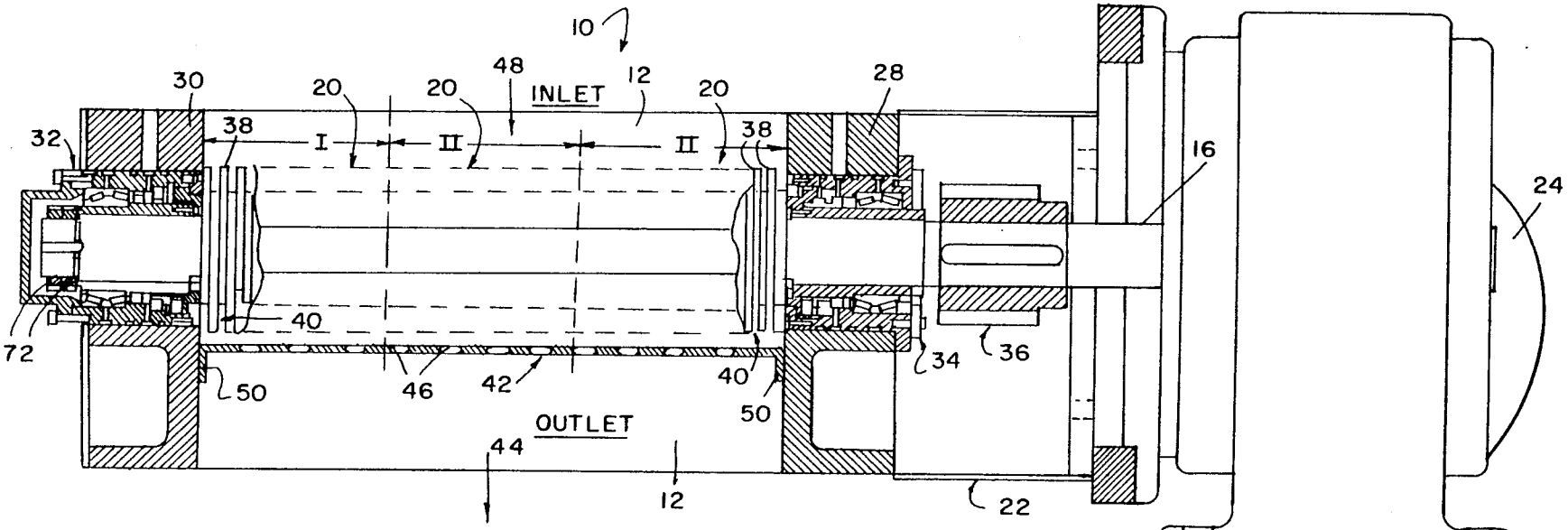
FIG. 2, is a view, partially in cross-section, of the apparatus shown in FIG. 1, taken along lines 2—2 of FIG. 1.

Referring to FIG. 2, there is shown a view of the apparatus shown in FIG. 1, taken along lines 2—2, which depicts the locations of the several component parts of apparatus 10. As shown housing 12 and shaft support members 28 and 30 are affixed to housing member 12, support member 28 near the drive arrangement 22 and member 30 at the rear end of the apparatus. Shaft 16 is axially supported by rear member 30 by means of a rear bearing device 32 and at the other end by a front housing shaft support member 28 and a front end bearing support device 34. A gearing device 36 mounted on shaft 16 is part of the drive arrangement 22 which is utilized to rotate shaft 16 in opposing rotational direction to shaft 14. As illustratively shown, one or more, i.e. three unitary cutter body members 20 are mounted on shaft 16 spanning the entire axial length of the crushing and shredding length. Cutter body members 20 have a plurality of cutting teeth 38 separated by a spacing or separation distance 40 between adjacent teeth.

Continuing with the description for FIG. 2, there is shown a sizing means or screen 42 disposed in fixed spaced apart parallel relationship to cutter body members 20, extending the full length thereof and beneath members 20 on an outlet side 44 of housing 12. Sizing screen 42 has a plurality of preselected openings 46 through which properly sized and shaped comminuted refuse materials pass. The initial refuse material to be comminuted enters the apparatus through inlet 48. Screen 42 is held in fixed place by the aid of support means 50.

Figure 3:
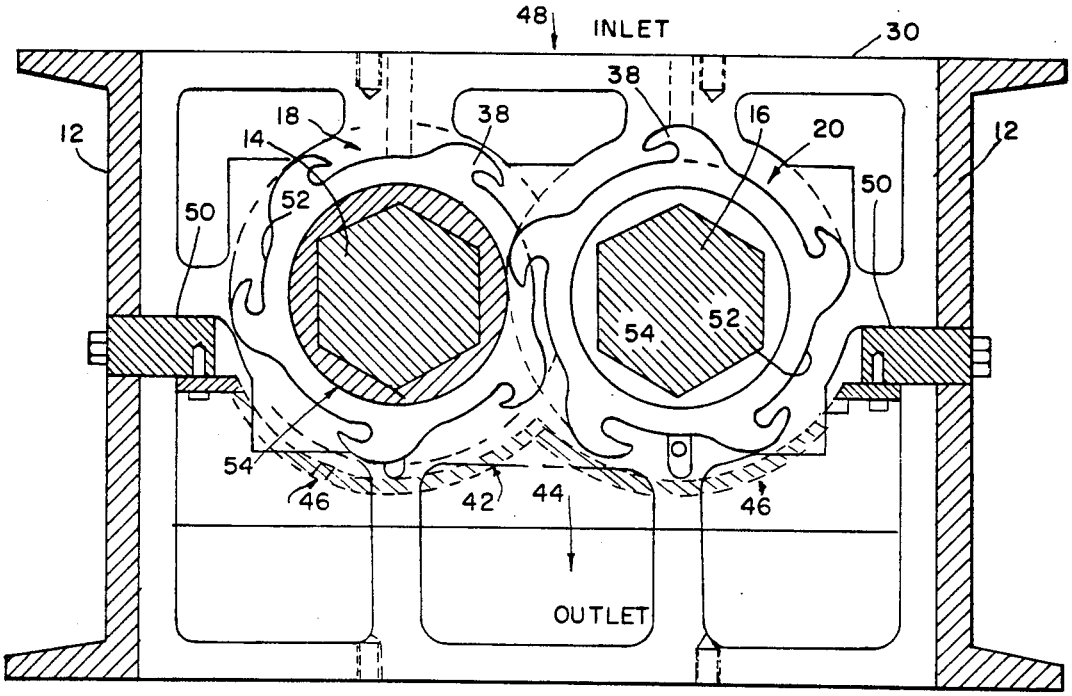
FIG. 3, is an illustrative cross-section view of the apparatus shown 1, taken along lines 3—3 of FIG. 1.

With reference to FIG. 3, there is shown a view of the apparatus of FIG. 1, taken along lines 3—3 thereof. As shown in FIG. 3, the spaced apart fixed relationship of parallel twin shafts 14 and 16 are seen along with the relationship of opposing cutter body members 18 and 20. In this view the cutting teeth 38 can be readily seen as to how they project outwardly from shafts 14 and 16, and their relative peripheral space relation. As shown teeth 38 extend radially from a circular portion 52 of bodies 18 and 20 and are axially concentric with another circular portion 54 thereof. The distance between circular portion 54 of the respective opposing rotating member defines the region along the axial length of the apparatus where crushing, tearing, shredding and the like of refuse material occurs. It should be noted that the teeth 38 on the different shafts cut in opposing angular directions.

Figure 4:
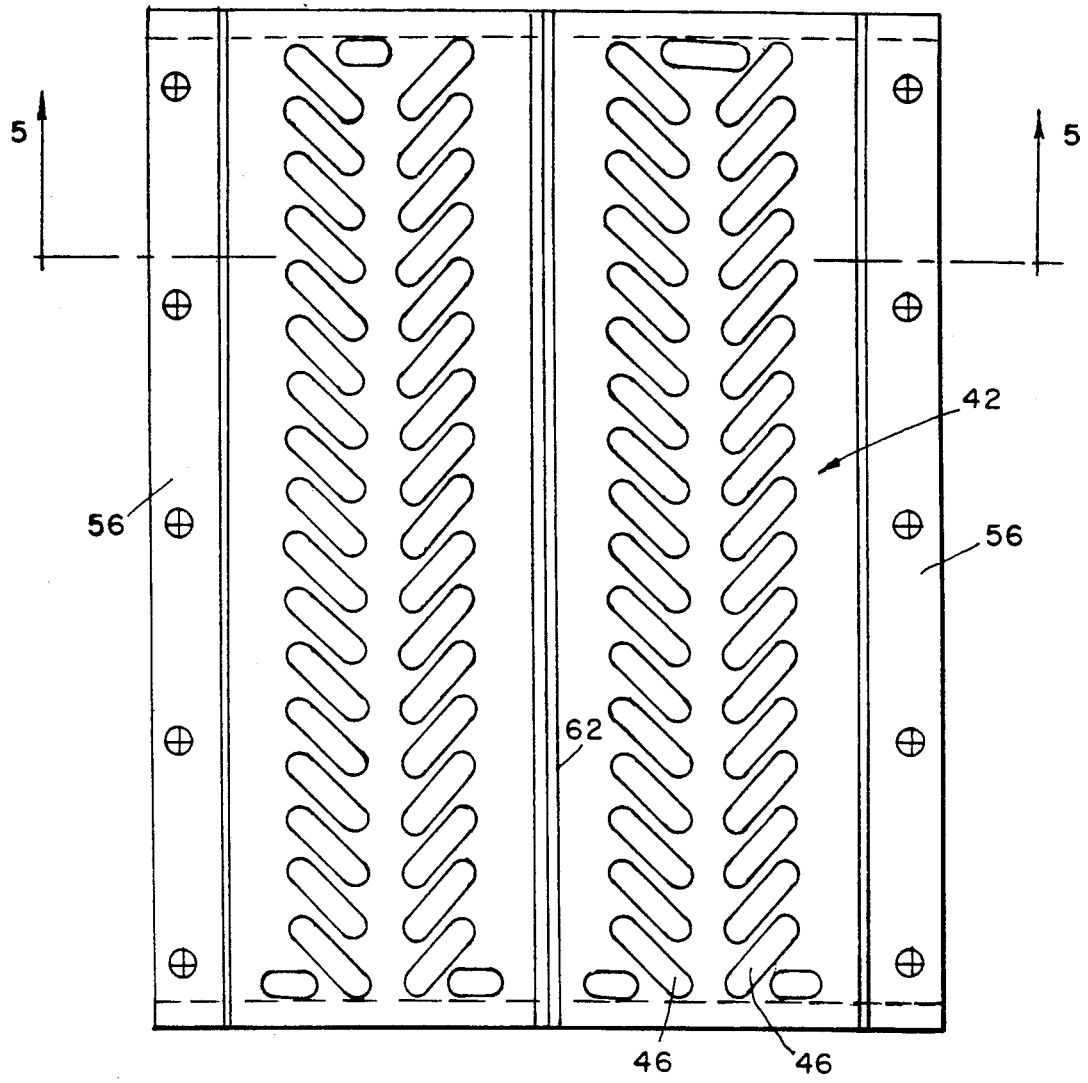
FIG. 4, is a plan view of a sizing member or screen with openings therein, which is utilized to size shredded or crushed solid waste materials in the apparatus shown in FIG. 1.
Figure 5:
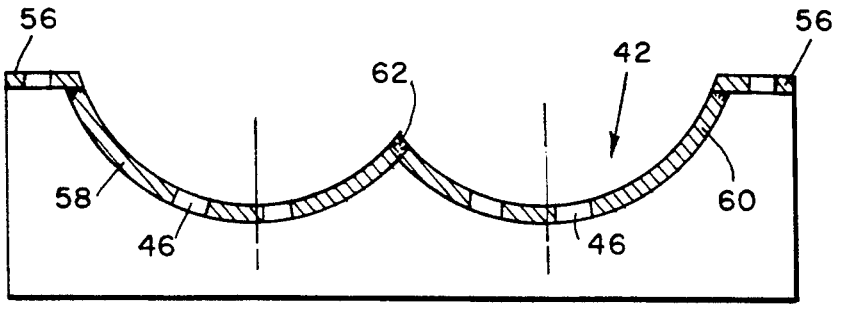
FIG. 5, is a cross-section view of the sizing screen shown in FIG. 4, taken along lines 5—5 of FIG. 4.

Referring to FIG. 4, there is shown a plan view of sizing screen 42 and the sizing opening 46 therein. Strips 56 of screen 42 are disposed in spaced apart parallel strips extending the axial thereon to provide means fixing the screen 42 in place with respect to the outlet side of the apparatus. FIG. 5, is a side view of screen 42 taken along lines 5—5 of FIG. 4, and depicts a twin curvilinear structure consisting a pair of circular arc members 58 and 60, welded together along their axial length forming a seam 62 therealong. The curved configuration of the screen members is adapted to cooperate with adjacent disposed opposing rotational cutter body members so as to provide means whereby improperly sized material is carried from the outlet side to the inlet side of the apparatus and repeatedly comminuted until it has been reduced to the size and shape required for passing through screen openings 46. It should be noted that the size and shape of the comminuted pieces of material may be controlled by the proper selection of design configuration and locational arrangement of openings 46 of the screen. Consequently, the design configuration of openings 46 shown in FIG. 4, is by way of example and is not to be considered as a limitation or as obvious as a matter of design choice. More particularly, considerable time and effort by way of experimentation is devoted to the development of an opening configuration for a selected sizing screen. The type of refuse to be comminuted is a primary factor in such selection along with information as to the ultimate uses for the comminuted materials. Screen 42 is removable so that screens having a wide range of configurations may be used to produce the sizes of comminuted materials desired.

Figure 6:
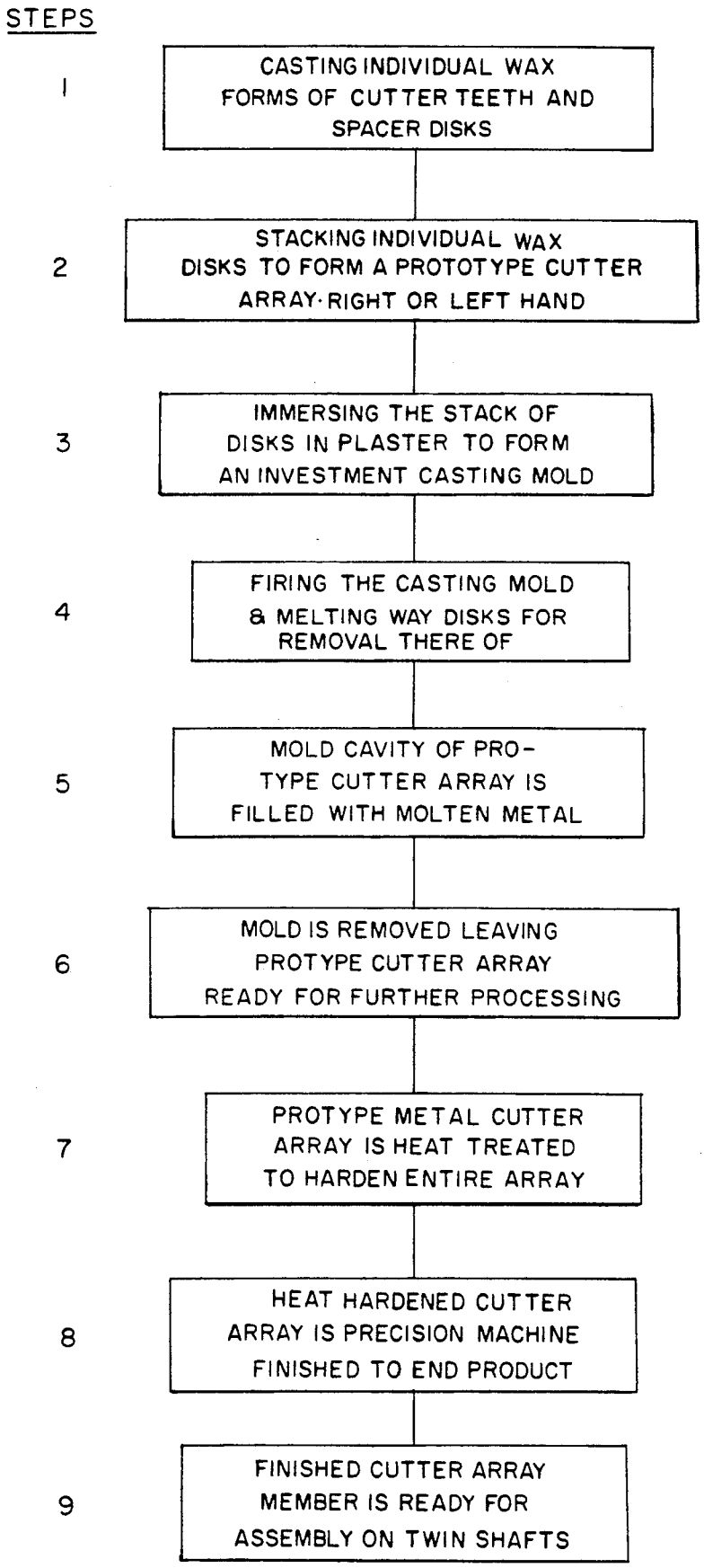
FIG. 6, is a block diagram illustrating the several steps in a process for producing individual unitary one piece cutter body members for use in the apparatus shown in FIG. 1.

Referring now to FIG. 6, there is shown a block diagram depicting several steps of a process utilized in accordance with the present invention for producing a typical cutter body member for use in the present invention as disclosed herein. More specifically, there is shown in FIG. 6, the nine basic steps to the method or process used for producing a unitary cutter body member, such as member 18 as shown in FIG. 7. Step 1, of the process requires that suitable selected casting wax material be used to form one or more cutter disks having a hexagonal opening at the center thereof with a predetermined number of cutting teeth projecting outwardly from the periphery thereof in desired spaced apart distances along the periphery; and one or more circular spacer disks having a hexagonal opening at the center thereof are also formed. The configuration, thickness and sizes of the various cutter or spacer disks may be readily controlled so as to provide greater flexibility in the design and production of a wide range of cutter body members for diverse applications and uses.

Step 2, of the method calls for the individual wax castings of the cutter and spacer disks formed to be stacked to form a protype array of alternate cutters and spacers. The orientation or axial positioning of the cutter teeth is preselected, such as forming a staggered or spiral-like array for example, when multitooth cutter arrays are formed. The resulting configuration of an array may depend upon the axial length of the stacked array. The stacked array may be such that the cutting teeth form a clockwise or counter-clockwise configuration so that the opposing rotating members will intermesh with one another during operation of the comminuting machine. The clockwise and counter-clockwise relationship of rotation is often termed left-hand and righthand orientation. It should be noted that under certain design and application conditions an array may consist of only a cutter and a spacer disk in the formation of an unitary cutter body member.

Step 3, of the process calls for the alternately stacked cutter and spacer disks to be immersed in or appropriately coated with a suitable investment casting material, such as plaster for example, to form an investment casting mold of the stacked array of disks. The investment casting mold is then permitted to air dry and set firmly and hard.

Step 4, calls for the investment casting mold as a solid mass with the stacked array of wax disks therein to be fired at preselected elevated temperatures in an appropriately adapted firing furnace to melt the wax array of disks and the removal thereof and to temper the investment casting mold such that the mold is capatible with molten metal used to form the metal cutter body member envisioned by this invention.

Step 5 of the process, calls for filling the investment mold with a suitable molten metal, such as alloyed steel for example, which is permitted to solidify within the mold so as to form a metal array of the cutter and spacer disks as a unitary cutter body member having the desired configuration of cutting teeth properly oriented and spaced apart from one another both concentrically and axially. As noted above, certain design considerations may dictate that the cutter body member consist only of one cutter and one spacer segment in an array.

Step 6, calls for the removal of the investment casting mold so that the unitary cutter body member remains in tack and may be further processed.

Step 7, calls for the unitary cutter array or body member to be suitably high temperature heat treated and quenched so as to produce the desired hardness, tensile strength and the like for the entire body, in particular the cutter tooth or teeth, for compatibility with uses envisioned therefor.

Step 8 calls for various precision machining of the body which for example may be performed by one or more versatile multiaxial CNC precision machining centers, so as to produce the close tolerances and intricate configuration details of cutting teeth and spacings envisioned by the teachings of the invention.

Step 9 of the process calls for placing one or more of the right or left hand cutter body members on their respective twin shafts for intermeshing opposing rotational action in a comminuting machine as envisioned herein.

It should be noted that a primary objective of the process thus defined is to produce castings that are near-net shape, that is, produced close enough to the final dimensions of the cutter body such that machining is substantially reduced or eliminated. Experience with the present process, i.e. investment casting or loss-wax casting as the process is sometimes called, has proven useful as contemplated, in reducing significant precision machining. Materials such as selected liquid ceramic material mixtures may also be used in place of conventioal plasters, owing to their high temperature stability capabilities during high temperature firing and dimensional conformity upon cooling. In practice the process has been found to produce body configurations with dimensional quality precise enough to enable production parts to be made which require little or no further precision machining.

Continuing with the description of the present invention, there is shown in FIG. 7, a prospective view of a unitary cutter body member 18 produced by the process of FIG. 6, having a plurality of cutting teeth 38, axially separated by spacing distances 40. Also shown is an axial hexagonal opening 62 extending the length of the body. In order to reduce the machining process for the hexagonal opening, the hexagonal opening may be precision machined a distance only a few teeth and spaces in depth, at both ends of a body. As can readily be seen from FIG. 7, the axial contour of teeth 38 has a spiral-like or staggered appearance.

This staggered-like configuration has proven beneficial in certain applications, while for certain other materials to be comminuted it may be desireable to have a random tooth array. In addition to flexibility of contours which may be derived in the body structure, the over-all strength and duribility of the body has resulted. Contrary to the prior art cutter/spacer individual disk arrangements, the torsion, shear and the like forces developed during the comminuting process which are experienced by each tooth in the cutter body are distributed and/or dissipated along the entire axial length thereof so as to produce a body structure which has unusual and unexpected enhanced strength and durability over any known prior art device. In many operational tests of these body members it has been found that devices having cutter teeth whose widths, shapes and size are similar to prior art devices with individual cutters and spacers, are able to carry working loads of at least 50% more than those of prior art devices.

Figure 8:
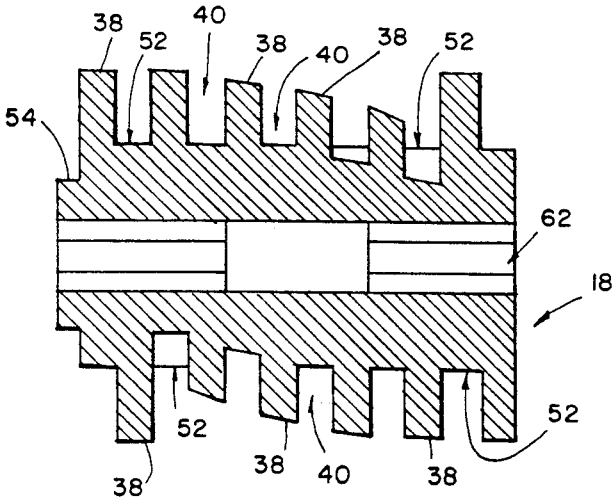
FIG. 8, is an illustrative cross-section view of a cutter body member, taken along 8—8 of FIG. 7.

There is shown in FIG. 8, an illustrative cross-section view of the cutter body member 18 of FIG. 7 taken along lines 8—8 thereof. As shown in FIG. 8, a spiral-like effect of teeth 38 is readily seen, which results from the location and distribution of adjacent rows of teeth along the axial length of the cutter body member. From this cross-section view of the configuration of the body it can also be seen and appreciated by those skilled in the art how various loads applied thereto may be distributed to obviate the concentration thereof at any one point in the body, thereby enhancing its inherent overall body and individual tooth strength and load bearing capacity.

Figure 9:
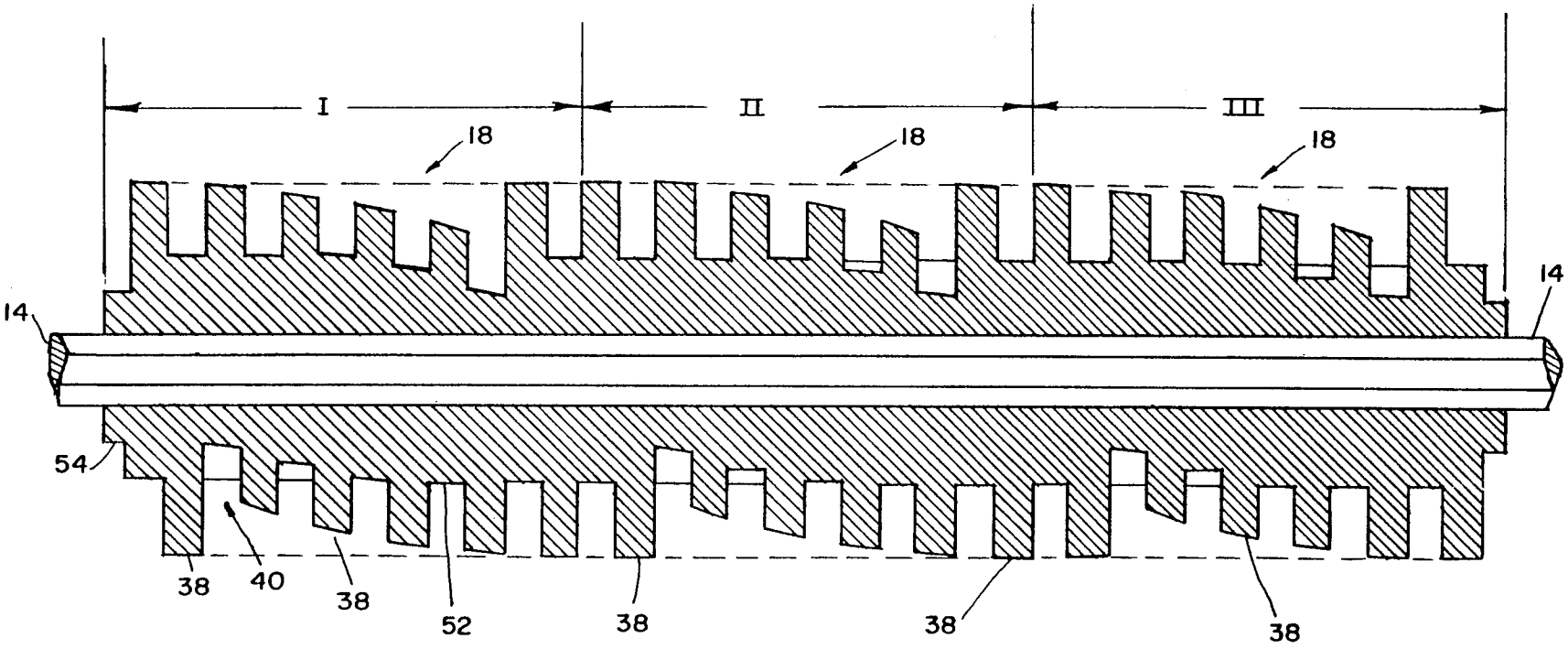
FIG. 9, is an illustrative cross-section view of three representative cutter body members for use on a twin shaft of an apparatus of the in FIG. 1.

FIG. 9, is a cross-section view in-part of three respective unitary cutter body members 18, mounted along a twin shaft 14 of the type shown in the various views and in particular FIG. 8. As shown in FIG. 9 the cutter body 18 illustrates how more than one body member may be utilized to form apparatus of various desired lengths depending upon the number of cutter bodies utilized. It can also be recognized that the present inventive cutter body members provide a convenient means for ease of repair and replacement to damaged parts. As shown each section I–III, profiles six teeth. However, a unitary body may have fewer or more teeth per member than is depicted. Removal of single unit or segment for replacement or repair is made easier and more convenient by use of such unitary body members.

Referring finally to FIG. 10, there is shown an axial plan view of a typical pair of cutter body members 18 and 20, and a top view thereof. As shown in each of the top views a triangular or chisel shaped configuration 64 and 66 for teeth 38, respectively for cutter bodies 18 and 20 is seen. The broken lines 68 and 70 respectively of cutters 18 and 20 indicate that the tips of teeth 38 may be square or in other configurations. The chisel-like shape shown is only illustrative of the various configurations teeth 38 may have for the purposes of meeting the requirements of a wide range of uses and applications and therefore, is not intended as a limitation of the inventive concept and scope of the invention.

In closing, it should be noted that cutter body members 18 and 20 are held in fixed mounted position on their respective shafts by means of bearing support devices 32 and 34, and a pair of threaded locking nuts which are screwed tightly onto the screw threaded ends of twin shafts 14 and 16 in contact with bearings 32. These bearing devices provide for smooth and efficient axial rotation of the respective shafts.

In operation the apparatus comminutes material introduced at inlet 48 and is crushed, shredded and the like by the twin cutter body members 18 and 20 which are adapted to rotate in opposite directions and at different relative speeds. The cutter body members 18 and 20 are fixedly mounted to their respective shafts having cutting teeth 38 distributed along the axis of the apparatus in intermeshing rotational spaced apart relationship to thereby comminute the materials introduced to the apparatus at its inlet. The comminuted materials pass between the cutter body members enroute to outlet 44 where improperly sized and shaped pieces are caught and retained by sizing screen 42 and then picked up by cutting teeth 38 and repeatedly lifted from the screen area and returned and recycled at inlet 48, until the material pieces are properly sized and shaped and passed through screen openings 46 out of the apparatus 10.

It is understood that the above described embodiments of the invention are only illustrative of the principals applicable thereto. Various modifications and adaptions may be envisioned by those skilled in the art when exposed to the disclosure and teachings herein, without departing from the spirit and scope of the invention and the claims appended hereto.

What is claimed as new is:

1. In an improved machine for comminuting bulky refuse material, the improvement comprising:

a. a pair of elongated parallel substantiall horizontal shafts adapted to rotate in opposite directions;

b. a one-piece cutter member having a plurality of spaced apart cutter teeth carried by and distributed along each shaft for rotation therewith, said cutter teeth having a uniform thickness and being spaced from each other tooth along each shaft by distances slightly greater than said thickness, whereby each of said teeth is capable of withstanding extensive radial loading forces owing to said teeth being an integral part of said unitary cutter member which is capable of absorbing said loading forces distributed along the length thereof.

c. each one-piece member having an inner circular portion surrounding the shaft on which it is mounted and a plurality of cutting teeth projecting from the periphery of a second circular portion concentric with said inner circular portion, the cutter teeth on one shaft being respectively aligned with the spaces between the cutting teeth on the other shaft, and said shafts being situated from each other by a distance which locates the peripheries of said inner circular portion of the cutter member on said shaft closely adjacent to each other so that the cutting teeth of the cutter member on one shaft passes through the spaces between the cutting teeth on the other shaft;

d. each one-piece cutter member disposed on opposing rotating shafts having a reverse spiral configuration of said member on opposing shaft so as to provide smooth intermeshing action during opposing shaft rotation;

e. a housing of substantially trough-shaped configuration accommodating said shafts and unitary cutter members in an interior of said housing, the latter having an upper inlet through which bulky material refuse is supplied to the rotary shafts and cutter members thereon and said housing having adjacent to a space through which said teeth rotate as a lower outlet; and f. a screen disposed beneath said lower outlet which prevents comminuted materials from passing downwardly through said outlet until the material refuse has been comminuted down to a given size and shape, said teeth functioning not only to comminute the material but also to raise the material from said outlet and repeatedly comminuting the material until it has been reduced to the size and shape required for passing through said screen.

2. Comminuting machine of claim 1 in which said pair of shafts in hexagonal in cross-section to thereby provide means for selected orientation of said one-piece cutter body members there-along for smooth intermeshing alignment and action between said one-piece cutter body members disposed on said shafts during said opposing shaft rotation.

3. Comminuting machine of claim 2 in which said one-piece unitary cutter member has an axial opening therethrough along a length thereof and said opening has hexagonal configuration.

4. In an improved cutter system for a twin shaft comminuting machine, the improvement comprising:

a. at least one one-piece cutter body member each having an axial opening therethrough along a length thereof and each adapted for fixed engagement of one of said twin shafts along said axial opening;

b. each of said body members having a plurality of cutting teeth distributed along the length thereof for rotation with said shafts, said cutting teeth having a uniform thickness and being spaced from each other tooth along the length thereof by distances slightly greater than said thickness;

c. each body member having an inner circular portion surrounding one of said twin shafts on which it is mounted and a plurality of spaced apart cutting teeth projecting from the periphery of a second circular body portion concentric with said inner circular portion, the cutting teeth on each of said body members mounted on said shafts being respectively aligned with the space between the cutter teeth on the other shaft and said shafts being situated from each other by a distance which locates the peripheries of said inner circular portion of the cutter body on said shaft closely adjacent to each other so that the cutter teeth of the cutter body on one shaft passes through the spaces between the cutting teeth on the other shaft; and d. each cutter body on opposing twin shafts having a reverse spiral configuration of each other so as to provide smooth intermeshing action during opposing twin shaft rotation.

5. Cutter system of claim 4, in which said axial opening is hexagonal.

6. Cutter system of claim 5, in which said twin shafts have a hexagonal cross-section to thereby provide means for selected orientation of said one-piece cutter body members there-along for smooth intermeshing alignment and action between said one-piece cutter body members disposed on said shafts during said opposing shaft rotation.

7. Cutter system of claim 6, in which said teeth have a chisel-like configuration.

8. In an improved cutter system for twin shaft comminuting machines, the improvement comprising:

a. a plurality of cutter teeth and spacer segments, said segments consisting of at least one alternate cutter teeth and spacer element as a one-piece body member, each having an axial opening therethrough and each adapted for fixed engagement of one of said twin shafts along said axial opening;

b. a plurality of said one-piece body members disposed along a length of said shafts forming a plurality of cutter teeth distributed therealong for rotation with said shafts, said teeth having a uniform thickness and being spaced from each other along said length by distances slightly greater than said thickness;

c. each body member having an inner circular portion surrounding one of said twin shafts on which it is mounted and a plurality of spaced apart cutting teeth projecting from the periphery of a second circular body portion concentric with said inner circular portion, the cutting teeth on each of said body members mounted on said shafts being respectively aligned with the space between the cutter teeth on the other shaft and said shafts being situated from each other by a distance which locates the peripheries of said inner circular portion of the cutter body on said shaft closely adjacent to each other so that the cutter teeth of the cutter body on one shaft passes through the spaces between the cutting teeth on the other shaft; and d. each cutter body on opposing twin shafts having a reverse spiral configuration of each other so as to provide smooth intermeshing action during opposing twin shaft rotation.

9. Cutter system of claim 8, in which said axial opening is hexagonal.

10. Cutter system of claim 9, in which said twin shafts have a hexagonal cross-section to thereby provide means for selected orientation of said one-piece cutter body members there-along for smooth intermeshing alignment and action between said one-piece cutter body members disposed on said shafts during said opposing shaft rotation.

11. Cutter system of claim 10, in which said teeth have a chisel-like shape.

12. In an improved comminuting machine for bulky refuse materials, the improvement comprising:

a. a housing of substantially trough-shaped configuration for accommodating a pair of elongated parallel shafts each having an axis therealong and being adapted to rotate in opposite directions and for accommodating at least one one-piece cutter body member on each shaft, said one-piece cutter body member on each shaft, said one-piece body member having a selected axial length, said housing having an upper inlet through which bulky refuse materials are supplied to said machine and an outlet for comminuted refuse materials to exit therefrom;

d. said one-piece cutter body members having a plurality of axially spaced apart body portions with a plurality of spaced apart cutting teeth extending coaxially from each of said portions, said body portions and cutting teeth having a selected thickness along said axis and being separated therealong by spacing distances slightly greater than said thickness of said adjacent cutting teeth, said cutting teeth having a contour of a staggered-like configuration along said one-piece cutter body members axial length;

c. said one-piece cutter body members having an axial opening therethrough adapted to firmly engage said elongated parallel shafts during the rotation thereof to thereby cause torsion and shear forces exerted on said body portions and teeth of said cutter body members while comminuting bulky refuse materials to be distributed and dissipated along said elongated parallel shafts so as to avoid concentration thereof on said body portions and cutting teeth thereof; and d. means adapted for imparting rotatary motion to said pair of elongated parallel shafts to thereby cause said shafts and engaging cutter body members to rotate in opposite directions for comminuting action therebetween.

13. Comminuting machine of claim 12 in which a plurality of intermeshing cutter body members are disposed along said shafts being adapted to form a plurality of cyclical comminuting sections along an axial length of said comminuting machine.

14. Comminuting machine of claim 13 in which said intermeshing cutter body members have diferent teeth configurations and arrangements than that of cutter body member of adjacent cyclical comminuting sections.

15. Comminuting machine of claim 13 in which said intermeshing cutter body members are disposed along said shaft being adapted to produce multiple spiral-like teeth configuration along the length of said machine.

16. Communiting machine of claim 13 in which said intermeshing cutter body members are disposed along said shaft being adapted to produce multiple chevron configurations along the length of said machine by reversing the axial orientation of every other pair of opposing cutter body members disposed on said elongate parallel shafts of the machine.

17. Comminuting machine of claim 13 in which said intermeshing cutter body members are disposed along said shaft being adapted to produce alternate cylical comminuting sections of spiral-like and cevron configurations along the length of the machine.

* * * * *